US009380883B1

(12) United States Patent
Mossbeck

(10) Patent No.: US 9,380,883 B1
(45) Date of Patent: Jul. 5, 2016

(54) POCKETED SPRING ASSEMBLY COMPRISING PERIMETER STRING OF SPRINGS HAVING RECTANGULAR CONVOLUTIONS

(71) Applicant: L&P Property Management Company, South Gate, CA (US)

(72) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 14/572,074

(22) Filed: Dec. 16, 2014

(51) Int. Cl.
*A47C 27/06* (2006.01)
*A47C 23/04* (2006.01)

(52) U.S. Cl.
CPC ..... *A47C 27/064* (2013.01); *A47C 23/04* (2013.01); *A47C 27/065* (2013.01); *A47C 27/066* (2013.01)

(58) Field of Classification Search
CPC ..... H04L 27/064; H04L 27/06; H04L 23/04; H04L 27/065; H04L 27/066; H04L 23/05; H04L 23/0507; H04L 23/002; H04L 23/043; H04L 23/0436; H04L 23/0433; H04L 23/0438
See application file for complete search history.

(56) References Cited

U.S. PATENT DOCUMENTS

| | | | | | |
|---|---|---|---|---|---|
| 304,678 | A * | 9/1884 | Tuttle | A47C 23/05 | 5/246 |
| 1,213,858 | A * | 1/1917 | Franz | A47C 27/064 | 5/256 |
| 1,683,684 | A * | 9/1928 | MacInerney | A47C 27/04 | 5/655.8 |
| 2,715,435 | A * | 8/1955 | Rymland | A47C 27/062 | 267/93 |
| 3,083,381 | A | 4/1963 | Bailey | | |
| 3,821,823 | A * | 7/1974 | Krier | A47C 27/065 | 5/269 |
| 4,101,993 | A * | 7/1978 | Yates | A47C 23/0438 | 5/263 |
| 4,475,724 | A * | 10/1984 | Hancock | A47C 27/001 | 267/103 |
| 4,555,097 | A * | 11/1985 | Hiatt | A47C 23/0438 | 267/100 |
| 6,098,224 | A | 8/2000 | Gladney | | |
| 6,173,464 | B1 * | 1/2001 | McCune | A47C 27/064 | 267/91 |
| 6,295,676 | B1 | 10/2001 | Warner | | |
| 6,490,744 | B1 * | 12/2002 | Schulz, Jr. | A47C 27/063 | 5/716 |
| 6,684,435 | B1 * | 2/2004 | Wells | A47C 27/062 | 5/248 |
| 6,813,791 | B2 * | 11/2004 | Mossbeck | A47C 27/064 | 5/716 |
| 2004/0172767 | A1 | 9/2004 | Mossbeck et al. | | |
| 2012/0102658 | A1 * | 5/2012 | Mantzis | A47C 27/062 | 5/720 |

FOREIGN PATENT DOCUMENTS

| | | |
|---|---|---|
| CN | 2279847 | 4/1998 |
| CN | 2809327 | 8/2006 |
| GB | 173373 | 7/1921 |
| GB | 196356 | 10/1922 |
| GB | 2120544 | 12/1983 |

* cited by examiner

*Primary Examiner* — David E Sosnowski
*Assistant Examiner* — Amanda L Miller
(74) *Attorney, Agent, or Firm* — Wood, Herron & Evans, LLP

(57) ABSTRACT

A bedding or seating product comprises a pocketed spring assembly comprising a plurality of parallel interior strings of individually pocketed coil springs. The interior strings of springs may extend from head-to-foot or side-to-side of the product. The pocketed spring assembly further comprises at least one perimeter string of springs. Each of the springs of each perimeter string of springs has rectangular convolutions to provide edge support to the product.

29 Claims, 16 Drawing Sheets

POCKETED SPRING ASSEMBLY COMPRISING PERIMETER STRING OF SPRINGS HAVING RECTANGULAR CONVOLUTIONS

TECHNICAL FIELD OF THE INVENTION

This invention relates to bedding and seating products and, more particularly, to pocketed spring assemblies used in bedding and seating products, including mattresses and the method of manufacturing such pocketed spring assemblies.

BACKGROUND OF THE INVENTION

Pocketed spring cores or assemblies are commonly used in seating or bedding products. Such pocketed spring assemblies are commonly made of multiple strings or rows of individually pocketed springs. Adjacent strings of individually pocketed springs are joined together by gluing or otherwise attaching the fabric of the strings of springs to each other.

Pocketed coil springs are often referred to as a Marshall construction in which each coil spring is encased within its own fabric sack or pocket. The sack or pocket is typically defined between two plies of a fabric strip connected together at intervals along transverse lines of attachment spaced along the strip. The two-ply fabric strip is generally formed by folding a strip of double width fabric upon itself along a longitudinal centerline, leaving the overlapped plies along the unjoined opposite edges of the strip to be connected to each other along a longitudinal seam. After the springs are inserted between the plies, opposed plies are joined along transverse lines of attachment to close the pockets and separate adjacent springs.

A variety of techniques have evolved for the manufacture of pocketed springs, some contemplating the creation of the pockets within the fabric plies prior to insertion of the wire spring and others contemplating the insertion of compressed wire springs between the plies of the strip and the subsequent creation of the pockets by joining the two plies to each other along transverse lines of attachment between adjacent springs. In recent times, heat sensitive fabric and ultrasonic welding techniques have been utilized to join the fabric plies together along the seams or lines of attachment.

Pocketed spring assemblies are often inserted into a foam partial encasement or "bucket" as the term is used in the art. One or more upper layers of material may be located on top of the "bucket" to complete the foam encasement. The foam encasement may provide edge support and the appearance of a support border. If such foam encased pocketed spring assemblies are roll packed, the foam rails or any portion of the foam encasement may be damaged. If the roll is stored, transported and stored at the location of a bedding manufacturer for too long, the foam may not return to its original intended form when unrolled at the bedding manufacturer.

It is therefore an objective of this invention to provide a seating or bedding product which has a pocketed spring assembly interior and a perimeter of pocketed springs which may eliminate the need for a foam encasement.

Still another objective of this invention is to provide a seating or bedding product which has a pocketed spring assembly having an edge support made of pocketed springs with the appearance of a foam encasement.

SUMMARY OF THE INVENTION

The invention of this application which accomplishes these objectives comprises a seating or bedding product made from an assembly of pocketed springs, each spring of which is contained within a fabric pocket. The pocketed spring assembly comprises a plurality of interior strings of springs which may extend longitudinally (end-to-end) or transversely (side-to-side) in the product and at least one perimeter string of springs surrounding the interior strings of springs.

One advantage of a pocketed spring assembly utilizing the present invention is that multiple pocketed spring assemblies may be roll packed, shipped to a desired destination for further manufacture and unrolled without damage to the individual pocketed spring assemblies.

According to one aspect of the invention, the bedding or seating product comprises a pocketed spring assembly comprising a plurality of parallel interior strings of springs joined to each other. Each of the interior strings of springs comprises a plurality of interconnected pockets, each of the pockets containing at least one coil spring encased in fabric. The fabric is joined to itself along a longitudinal seam which may be located along one side of the string of springs. Adjacent individually pocketed springs are separated from each other by at least one separating seam joining opposed first and second plies. The pocketed spring assembly further comprises at least one perimeter string of springs. Each perimeter string of springs comprises a plurality of interconnected perimeter pockets, each of the perimeter pockets containing at least one perimeter spring having rectangular convolutions. Each perimeter spring is encased in fabric. Cushioning materials may be on at least one side of the product. A covering may encase the pocketed spring assembly and cushioning materials.

According to another aspect of the invention, a pocketed spring assembly for use in a bedding or seating product comprises a plurality of interior strings of springs joined together. Each of the interior strings of springs comprises a piece of fabric joined to itself along a longitudinal seam and multiple spaced separating seams to define a plurality of pockets. Each pocket contains at least one coil spring. Each of the springs has end turns and central convolutions between the end turns. Opposed plies of the fabric are joined together by the at least one separating seam. The pocketed spring assembly further comprises at least one perimeter string of springs. Each perimeter string of springs comprises a plurality of interconnected perimeter pockets, each of the perimeter pockets containing at least one perimeter spring having rectangular convolutions. Each perimeter spring is encased in fabric and comprises rectangular end turns and rectangular central convolutions between the end turns. According to one embodiment, the convolutions of each perimeter spring, including the end turns, are square.

According to another aspect of the invention, a pocketed spring assembly for use in a bedding or seating product comprises a plurality of interior strings of springs joined together. Each of the interior strings of springs comprises a piece of fabric joined to itself along a longitudinal seam and multiple spaced separating seams to define a plurality of pockets. Each pocket contains at least one interior spring, each interior spring having circular upper and lower end turns and central convolutions between the end turns. Each of the separating seams joins opposed first and second plies of an interior string of springs. The pocketed spring assembly further comprises at least one perimeter string of springs. Each perimeter string of springs comprises a plurality of interconnected perimeter pockets, each of the perimeter pockets containing at least one perimeter spring having square convolutions. Each perimeter spring is encased in fabric and comprises square end turns and square central convolutions between the end turns which give the appearance of a conventional foam encasement.

According to another aspect of the invention, a pocketed spring assembly constructed in accordance with the present invention may be posturized or have different regions of different firmness. Some of the strings of springs may contain conventional coil springs, while other strings of springs may contain springs having rectangular convolutions, thus imparting different firmnesses to the different strings of springs. Different regions or sections of the pocketed spring assembly may be made of different strings of springs to impart different firmnesses to the regions.

According to another aspect of the invention, a pocketed spring assembly for use in a bedding or seating product may comprise an interior portion comprising strings of pocketed springs joined together and at least one perimeter string of springs. The perimeter pocketed springs of the perimeter string of springs may have a height greater than the height of the pocketed coil springs of the interior strings of springs. Alternatively, the height of the perimeter pocketed springs of the perimeter string of springs may be less than the height of the pocketed coil springs of the interior strings of springs. In another embodiment, the height of the perimeter pocketed springs of the perimeter string of springs may be identical to the height of the pocketed coil springs of the interior strings of springs.

These and other objects and advantages of this invention will be more readily apparent from the following description of the drawings, in which:

DETAILED DESCRIPTION OF THE DRAWINGS

Figure 1:
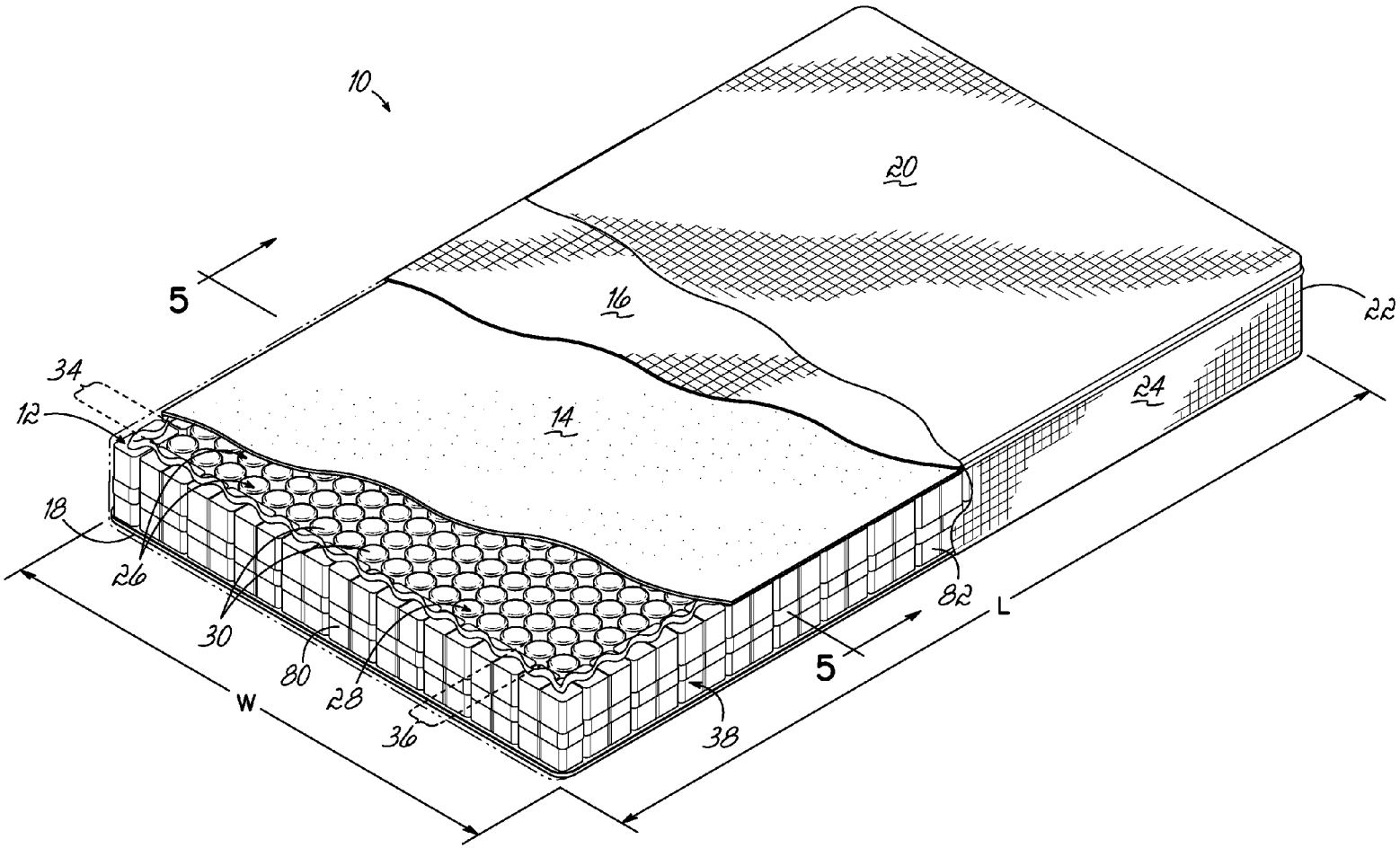
FIG. 1 is a perspective view, partially broken away, of a bedding product incorporating one embodiment of pocketed spring assembly.

With reference to FIG. 1, there is illustrated a bedding product in the form of a single-sided mattress 10 incorporating this invention. This product or mattress 10 comprises a pocketed spring assembly 12 over the top of which there lay conventional padding or cushioning layers 14, 16 which may be foam, fiber, gel, a pocketed spring topper or any other suitable materials. Although two padding or cushioning layers 14, 16 are illustrated on top of the pocketed spring assembly 12, any number of padding or cushioning layers may be used, including a single padding or cushioning layer. The pocketed spring assembly 12 is mounted upon a base 18 and is completely enclosed within a covering material 20.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the products shown and described herein, the length is illustrated as being greater than the width. However, it is within the contemplation of the present invention that the length and width may be identical, as in a square product.

While the mattress 10 illustrated in FIG. 1 is a single-sided mattress, the pocketed spring assembly 12, or any other pocketed spring assembly shown or described herein, may be incorporated into any bedding or seating product, including a double-sided mattress or seating cushion.

Figure 9:
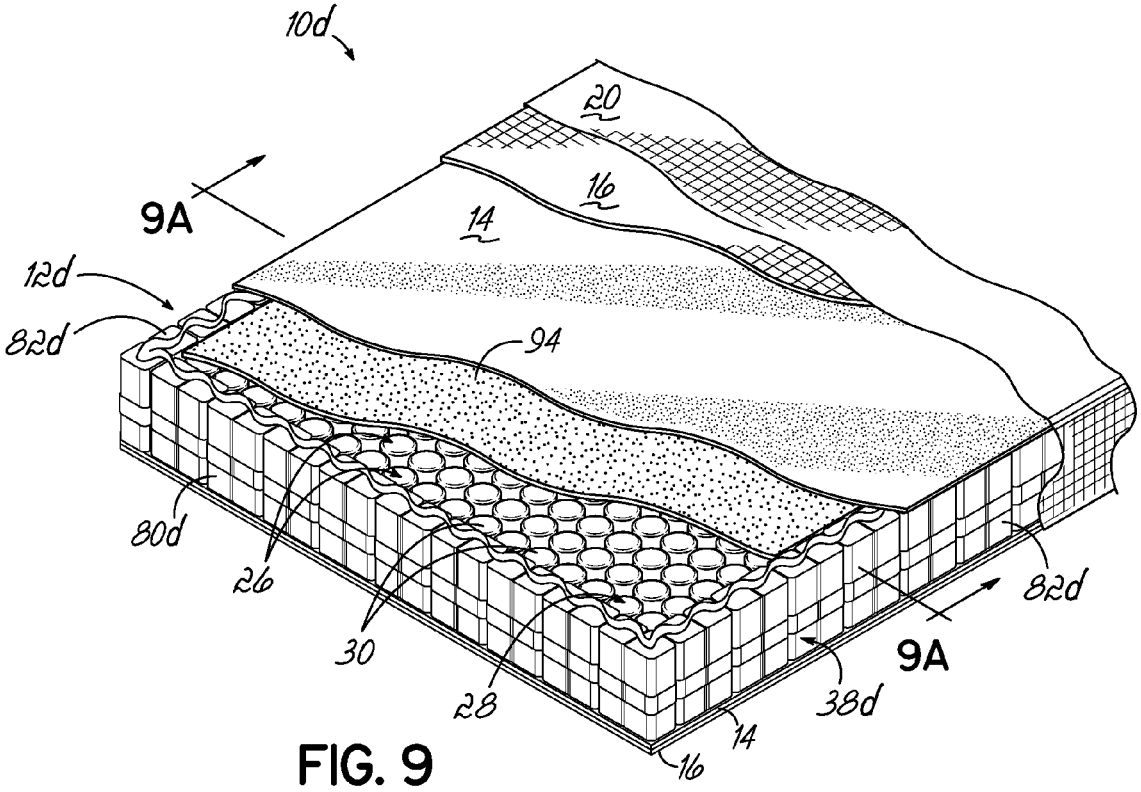
FIG. 9 is a perspective view, partially broken away, of a portion of an alternative pocketed spring assembly.
Figure 9A:
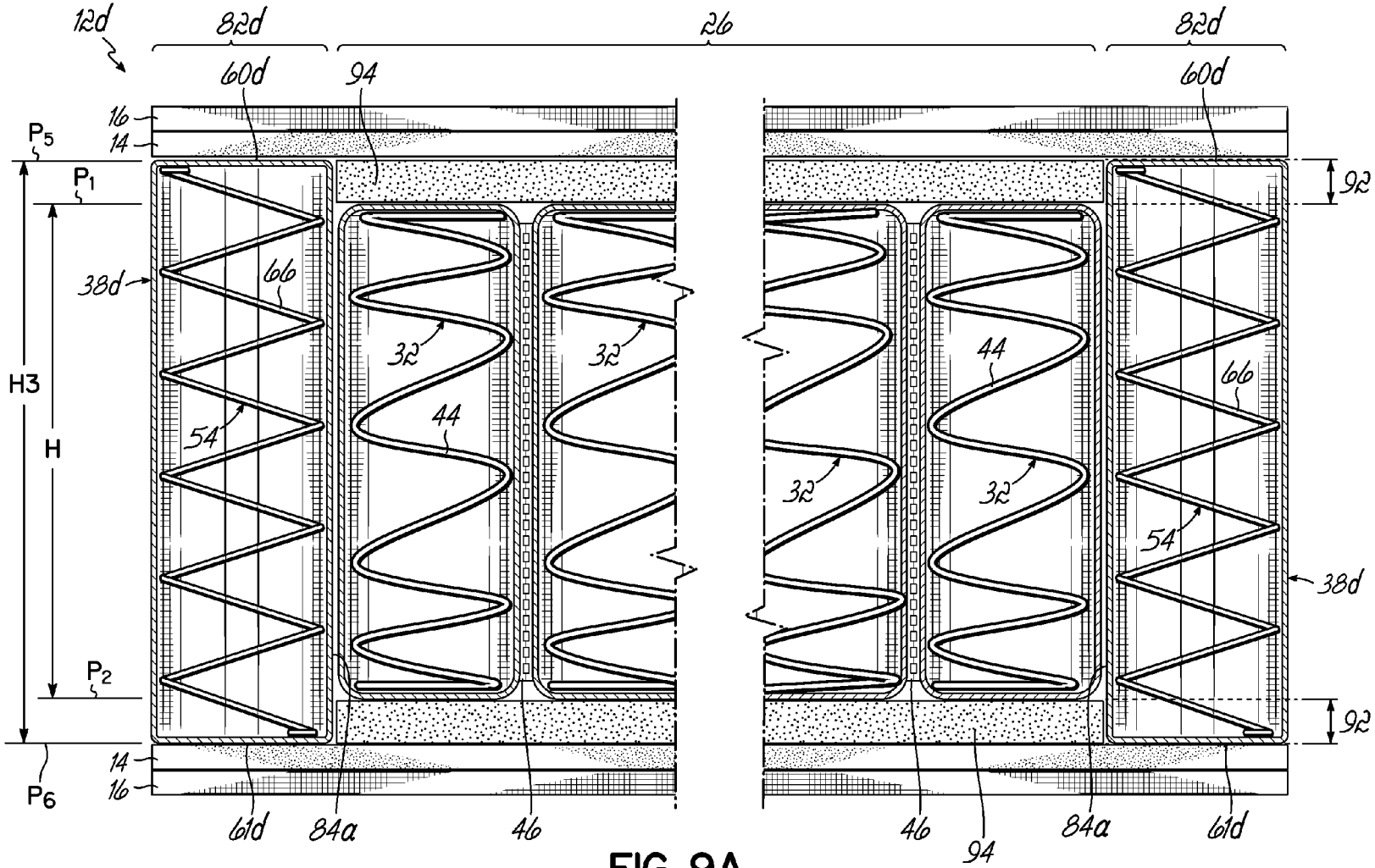
FIG. 9A is a cross-sectional view, partially broken away, taken along the line 9A-9A of FIG. 9 without the covering.

FIGS. 9 and 9*a* illustrate a double-sided mattress 10*d* comprising a pocketed spring assembly 12*d* different than the pocketed spring assembly 12 shown in the mattress 10 of FIG. 1. For example, the mattress 10*d* of FIGS. 9 and 9*a* has conventional padding layers 14, 16 above and below the pocketed spring assembly 12*d*.

According to the practice of this invention, any of the padding or cushioning layers may be omitted in any of the embodiments shown or described herein. The novel features reside in the pocketed spring assembly 12.

As shown in the embodiment illustrated in FIGS. 1-5, pocketed spring assembly 12 is manufactured from multiple interior strings of pocketed springs 26 joined together to form an interior pocketed spring core 28. Each interior string of pocketed springs 26 extends from side-to-side or transversely across the full width of the product 10. Although the interior strings of pocketed springs 26 are illustrated as extending transversely or from side-to-side in the pocketed spring assembly 12 of FIG. 1, they may extend longitudinally or from end-to-end in this or any other interior pocketed spring assembly shown or described herein.

Figure 5:
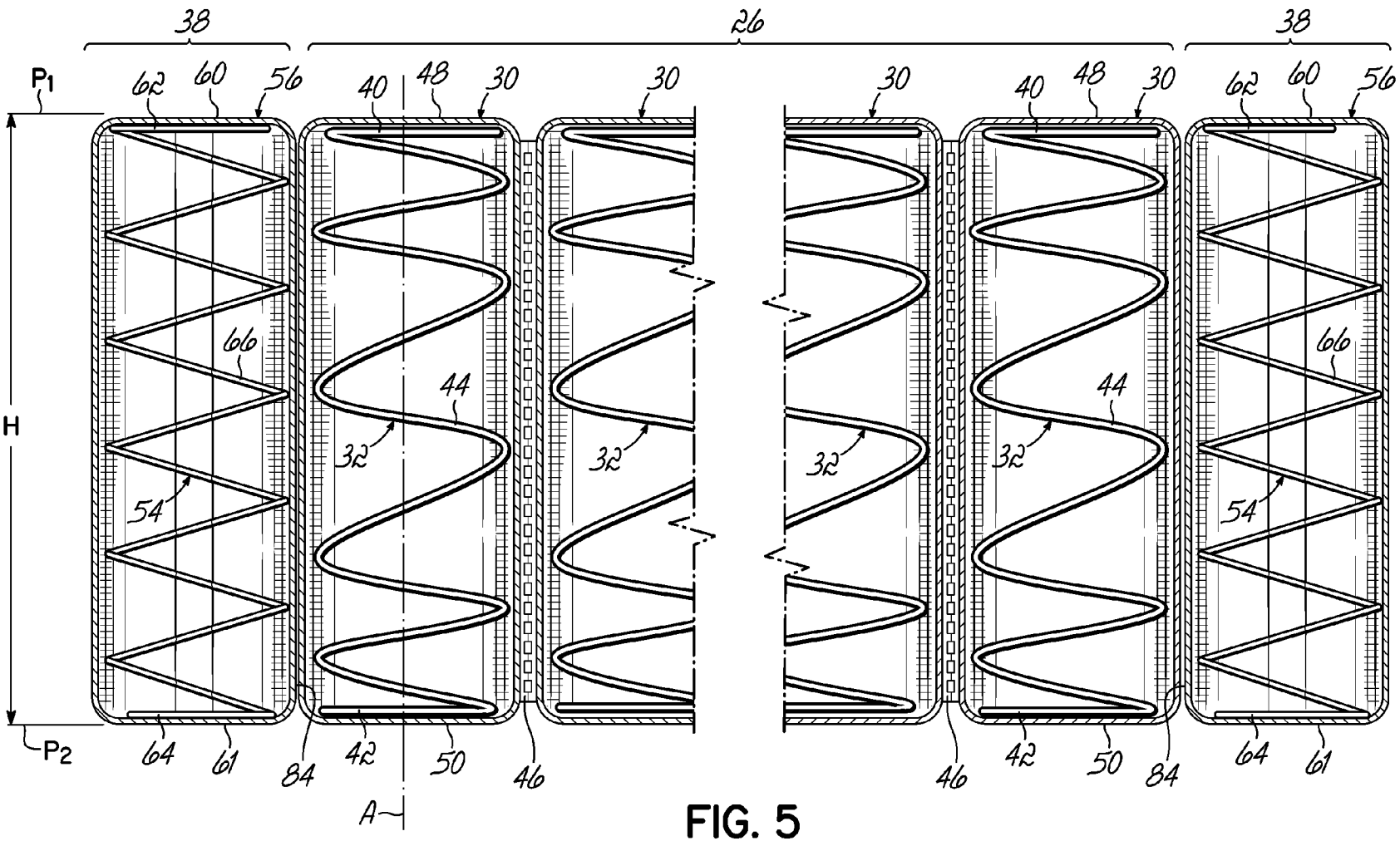
FIG. 5 is a cross-sectional view, partially broken away, taken along the line 5-5 of FIG. 1 without the covering.

These interior strings of pocketed springs 26 are connected in side-by-side relationship as, for example, by gluing the sides of the strings together in an assembly machine, so as to create an assembly or matrix of springs having multiple rows and columns of pocketed springs bound together as by gluing, welding or any other conventional assembly process commonly used to create pocketed spring cores or assemblies. As shown in FIG. 5, the interior strings of pocketed springs 26 are joined so that individual pockets 30 of coil springs 32 are aligned in transversely extending rows 34 and longitudinally extending columns 36. Although not shown, the interior strings of pocketed springs 26 may be offset from one another in the interior pocketed spring core 28.

The pocketed spring assembly 12 of mattress 10 further comprises a perimeter string of springs 38 surrounding interior pocketed spring core 28. The perimeter string of springs 38 is illustrated being one continuous string of pocketed springs 38 surrounding all four sides of interior pocketed spring core 28 and joined to itself using any conventional joining mechanism, including welding. However, the perimeter layer or layers of pocketed spring assembly 12 may comprise any number of perimeter strings of springs 38 joined together. For example, four perimeter strings of springs 38 may be joined together to form the perimeter layer, each perimeter strings of springs 38 being linear and joined to an adjacent side of the interior pocketed spring core 28.

As best illustrated in FIG. 5, each interior string of pocketed springs 26 comprises a row of interconnected fabric pockets 30. Each of the fabric pockets 30 contains at least one coil spring 32. As best shown in FIG. 5, each coil spring 32 has a central or longitudinal axis A, an upper end turn 40, a lower end turn 42 and a plurality of central convolutions 44 between the end turns. FIG. 5 illustrates a coil spring 32 in which the diameter of each end turn 40, 42 is identical to the diameter of the central convolutions 44. However, a barrel-shaped or hourglass-shaped coil spring may be located in some or all of the interior pockets 30 of some or all of the interior strings of springs 26 in any of the embodiments shown or described herein.

Preferably, one piece of fabric is used to create an interior string of pocketed springs 26, the piece of fabric being folded over onto itself around a plurality of aligned coil springs 32. As best shown in FIG. 5, opposite sides or plies of the fabric are sewn, welded or otherwise secured together in order to create a longitudinal seam (not shown) and a plurality of separating seams 46.

Although the seams in all of the embodiments shown herein are shown as being spaced rectangles, any of the seams may be spaced dots, triangles or solid line segments without spaces.

As shown in FIG. 5, the interior string of pocketed springs 26 has a generally planar top surface 48 in a top plane P1 and a parallel generally planar bottom surface 50 in a bottom plane P2. The linear distance between the top and bottom surfaces of the interior string of pocketed springs 26 defines a height H of the interior string of pocketed springs 26. This linear distance further defines the height H of the pocketed spring assembly 12 because each of the interior strings of springs 26 has the same height. However, it is within the scope of the present invention that different interior strings of springs of the interior core of a pocketed spring assembly have different heights.

Figure 2A:
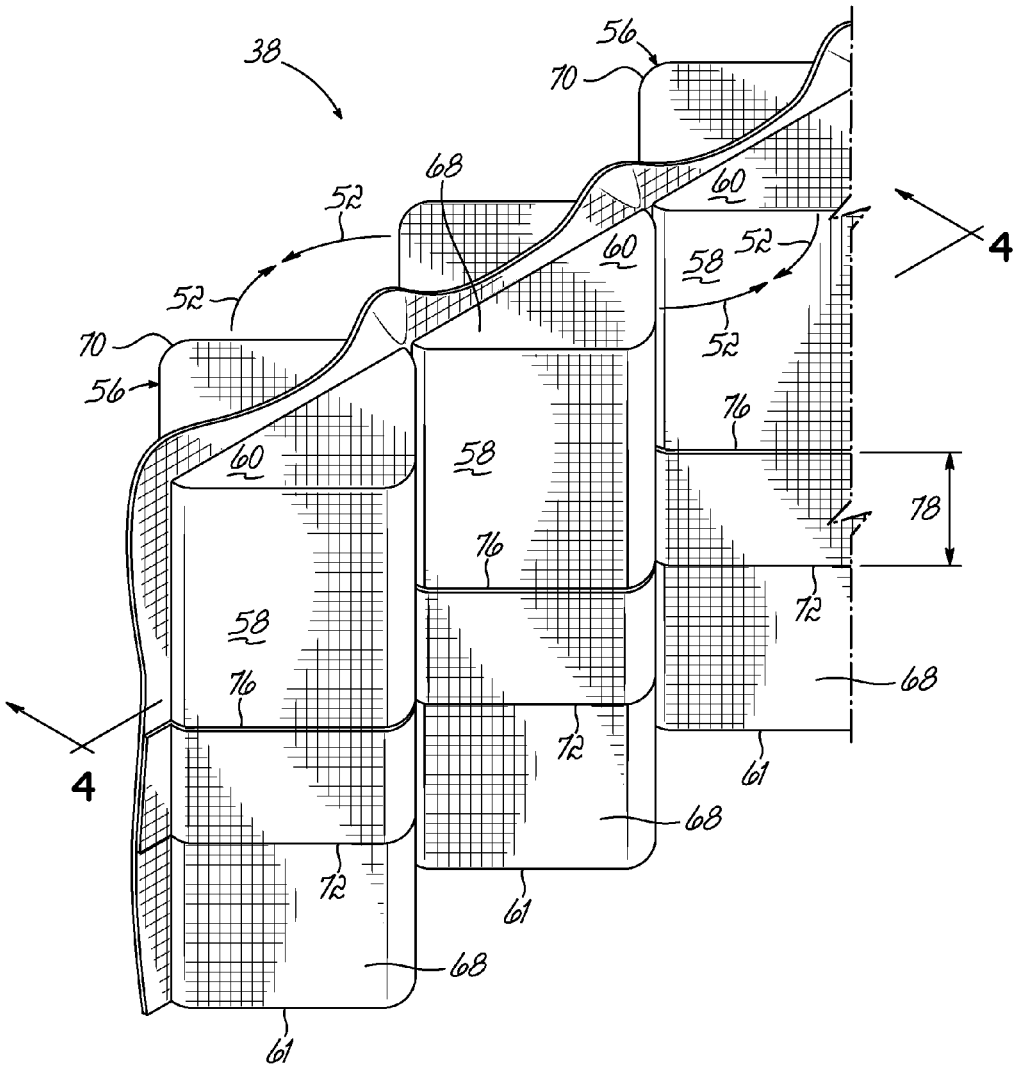
FIG. 2A is an enlarged perspective view of a portion of a string of pocketed perimeter springs used in the pocketed spring assembly of FIG. 1 before being folded.
Figure 4:
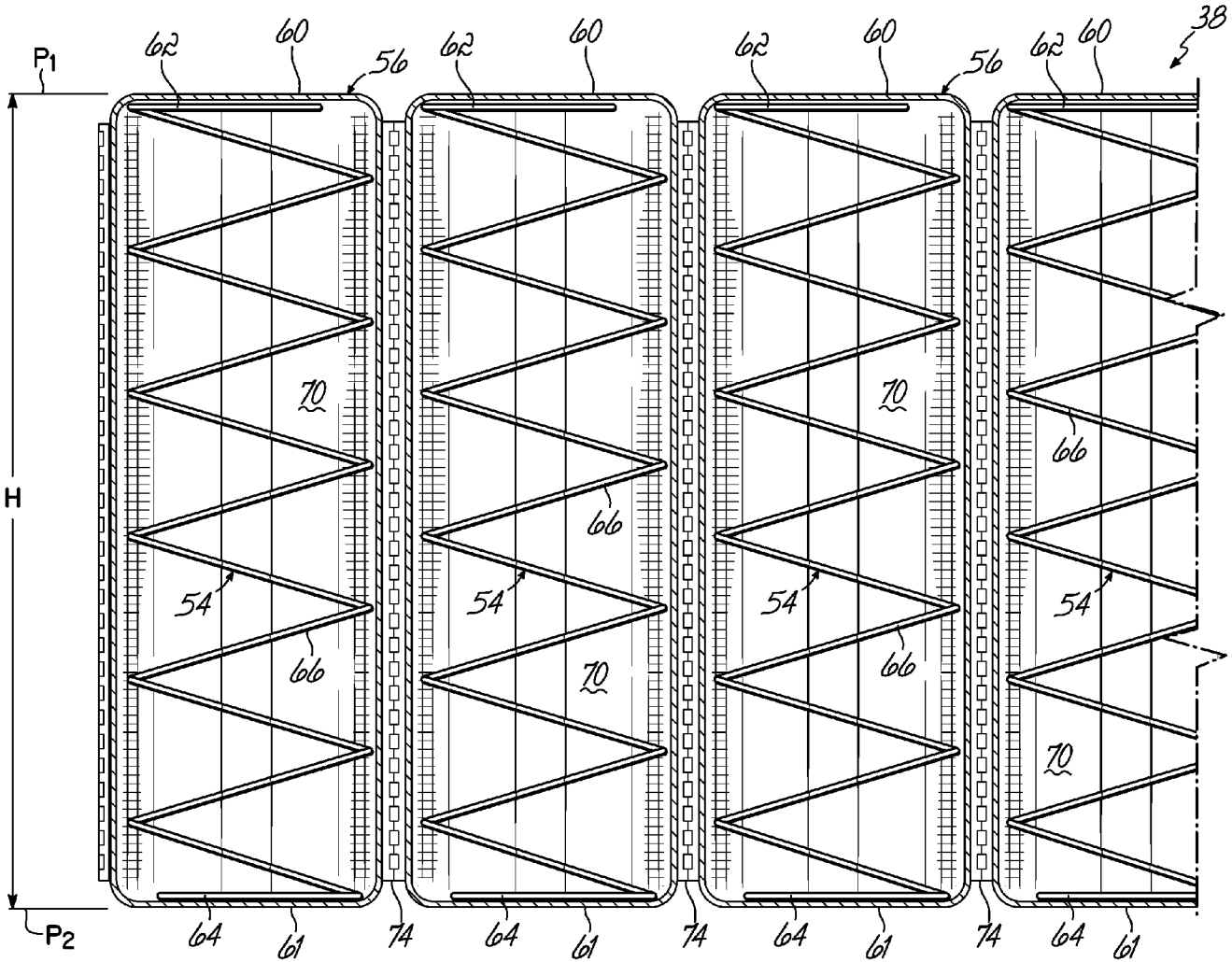
FIG. 4 is a cross-sectional view, partially broken away, of a portion of the perimeter strings of springs of the pocketed spring assembly of FIG. 1.

FIGS. 2A and 4 illustrate a portion of the perimeter strings of springs 38 in an open configuration before being folded into a closed configuration. As shown in FIG. 2A, once the perimeter strings of springs 38 is created in its open configuration, a machine or operator may rotate adjacent pockets in the direction of arrows 52, such that adjacent generally pocketed side surfaces contact each other. One primary advantage of the present invention is that the perimeter strings of springs 38, in its closed configuration and attached to the interior pocketed spring core 28, provides increased density and thus, edge support to the pocketed spring assembly 12.

Figure 2B:
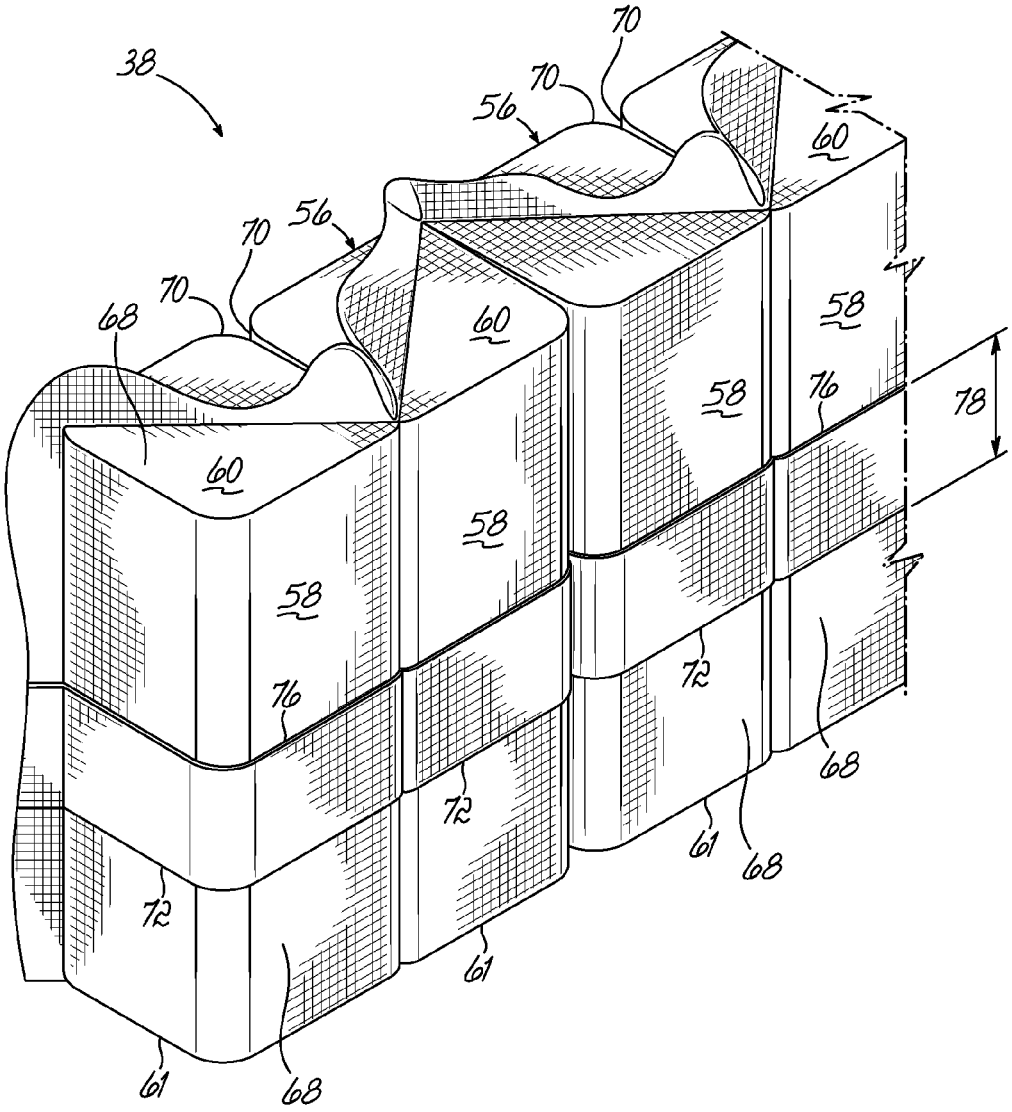
FIG. 2B is an enlarged perspective view of a portion of a string of pocketed perimeter springs used in the pocketed spring assembly of FIG. 1 after being folded.

As best shown in FIG. 4, each perimeter string of pocketed springs 38 comprises a row of interconnected fabric perimeter pockets 56. Each of the fabric perimeter pockets 56 contains at least one perimeter spring 54. As best shown in FIG. 2B, each perimeter pocket 56 comprises four identical side surfaces 58 and identical top and bottom surfaces 60, 61, respectively.

Figure 3:
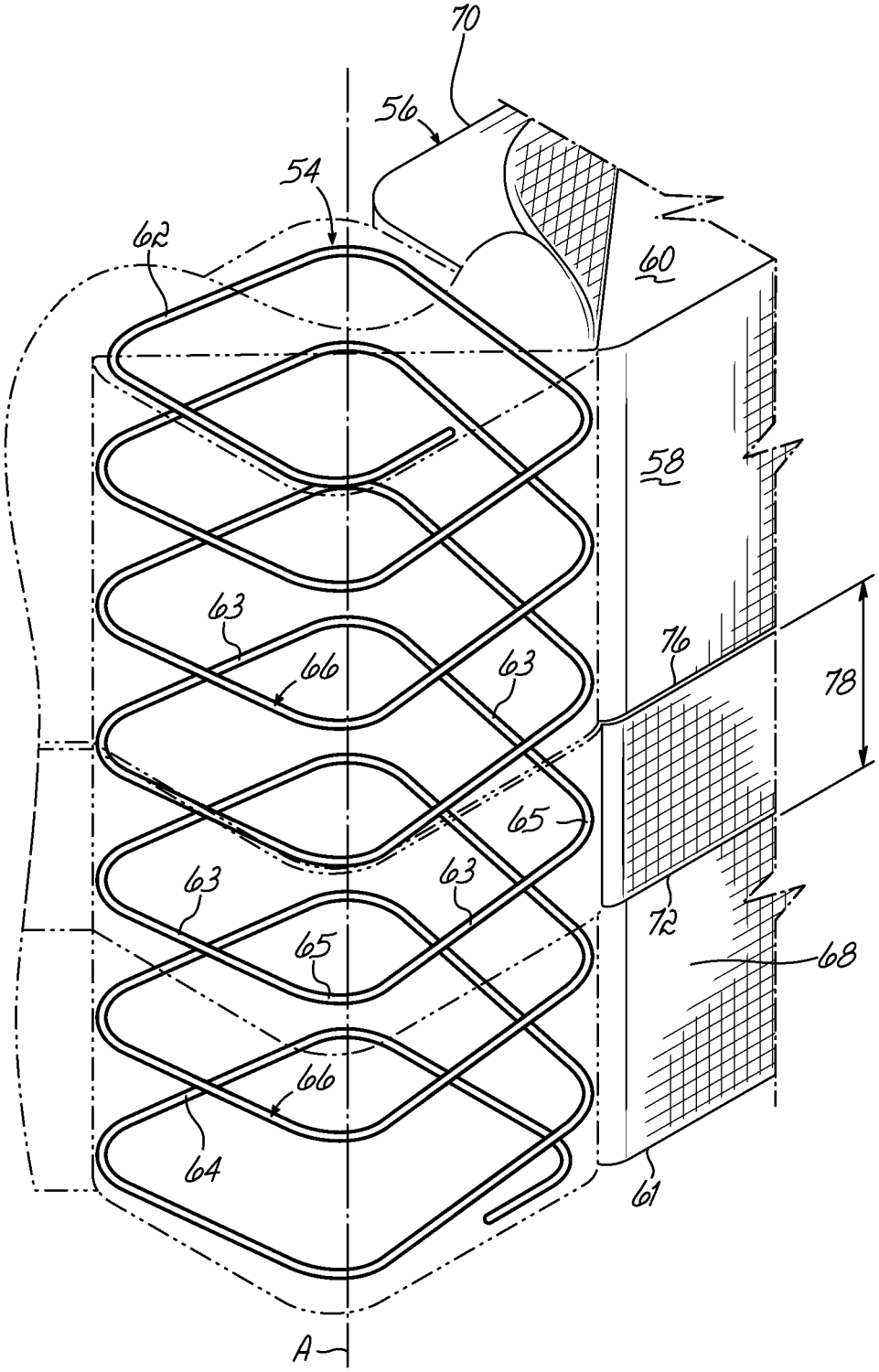
FIG. 3 is an enlarged perspective view, partially broken away, of a portion of a string of pocketed perimeter springs used in the pocketed spring assembly of FIG. 1.

As best shown in FIG. 3, each perimeter spring 54 has a central or longitudinal axis A, a rectangular upper end turn 62, a rectangular lower end turn 64 and a plurality of rectangular convolutions 64 between the end turns. Each of the rectangular convolutions 64 comprises four linear portions 63 joined together with rounded corner portions 65. In the perimeter spring 54 shown in the drawings, the rectangle is a square; however, the rectangle need not be a square. Any size rectangle may be used in any of the embodiments shown or described herein in accordance with the present invention.

Preferably, one piece of fabric is used to create each of the perimeter string(s) of pocketed springs 38, the piece of fabric being folded over onto itself around a plurality of aligned perimeter springs 54. As best shown in FIGS. 3 and 4, opposite sides or plies 68, 70 of the fabric are sewn, welded or otherwise secured together in order to create a longitudinal seam 72 and a plurality of separating seams 74. FIG. 2A illustrates ply 68 being closest to the reader and ply 70 being behind the perimeter springs 54.

As best shown in FIGS. 2A, 2B and 3, opposed edges 76 of the piece of fabric used to create the string of pocketed perimeter springs 54 are aligned and spaced from the longitudinal seam 72 a distance indicated by numeral 78. Although the drawings indicated the longitudinal seam 72 being below the free edges 76 of the piece of fabric, the longitudinal seam 72 may be above the free edges 76 of the piece of fabric.

As shown in FIGS. 4 and 5, the string of pocketed perimeter springs 38 has a generally planar top surface 60 in top plane P1 and a parallel generally planar bottom surface 61 in a bottom plane P2. The linear distance between the top and bottom surfaces of the string of pocketed perimeter springs 38 defines a height H of the string of pocketed perimeter springs 54. This linear distance further defines the height H of the pocketed spring assembly 12 because each of the interior strings of springs 26 and perimeter string of springs 38 has the same height. However, it is within the scope of the present invention that different strings of springs of a pocketed spring assembly have different heights, as will be described below.

As shown in FIG. 5, the perimeter string of springs 38 is glued or otherwise secured to the periphery of the interior pocketed spring core 28. As shown in FIG. 1, the perimeter string of springs 38 has a generally rectangular shape comprising two linear end portions 80 (only one being shown) and two linear side portions 82. The end portions 80 are glued or otherwise secured to the outermost transversely extending interior strings of springs 26, and the side portions 82 are glued or otherwise secured to the outermost pockets 30 of the transversely extending interior strings of springs 26 along seams 84. In the event, the interior strings of springs 26 were longitudinally, rather than transversely extending, the end portions 80 would be glued or otherwise secured to the outermost pockets 30 of the longitudinally extending interior strings of springs 26, and the side portions 82 would be glued or otherwise secured to the outermost longitudinally extending interior strings of springs 26.

Figure 6:
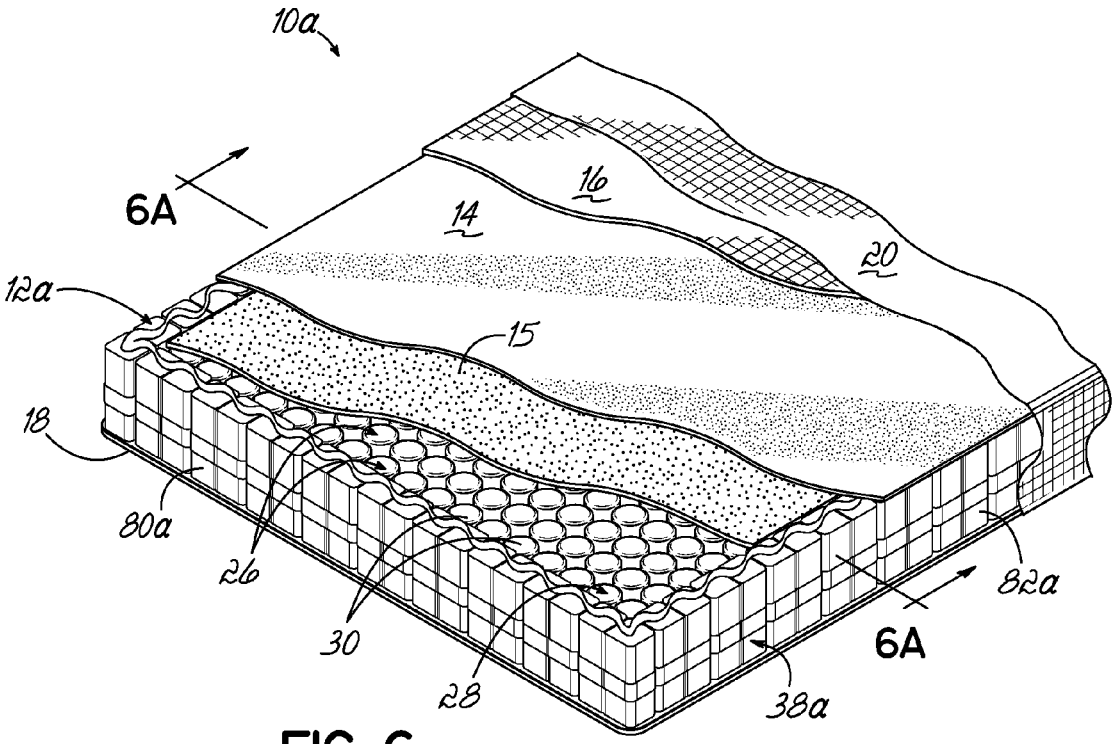
FIG. 6 is a perspective view, partially broken away, of a portion of an alternative pocketed spring assembly.
Figure 6A:
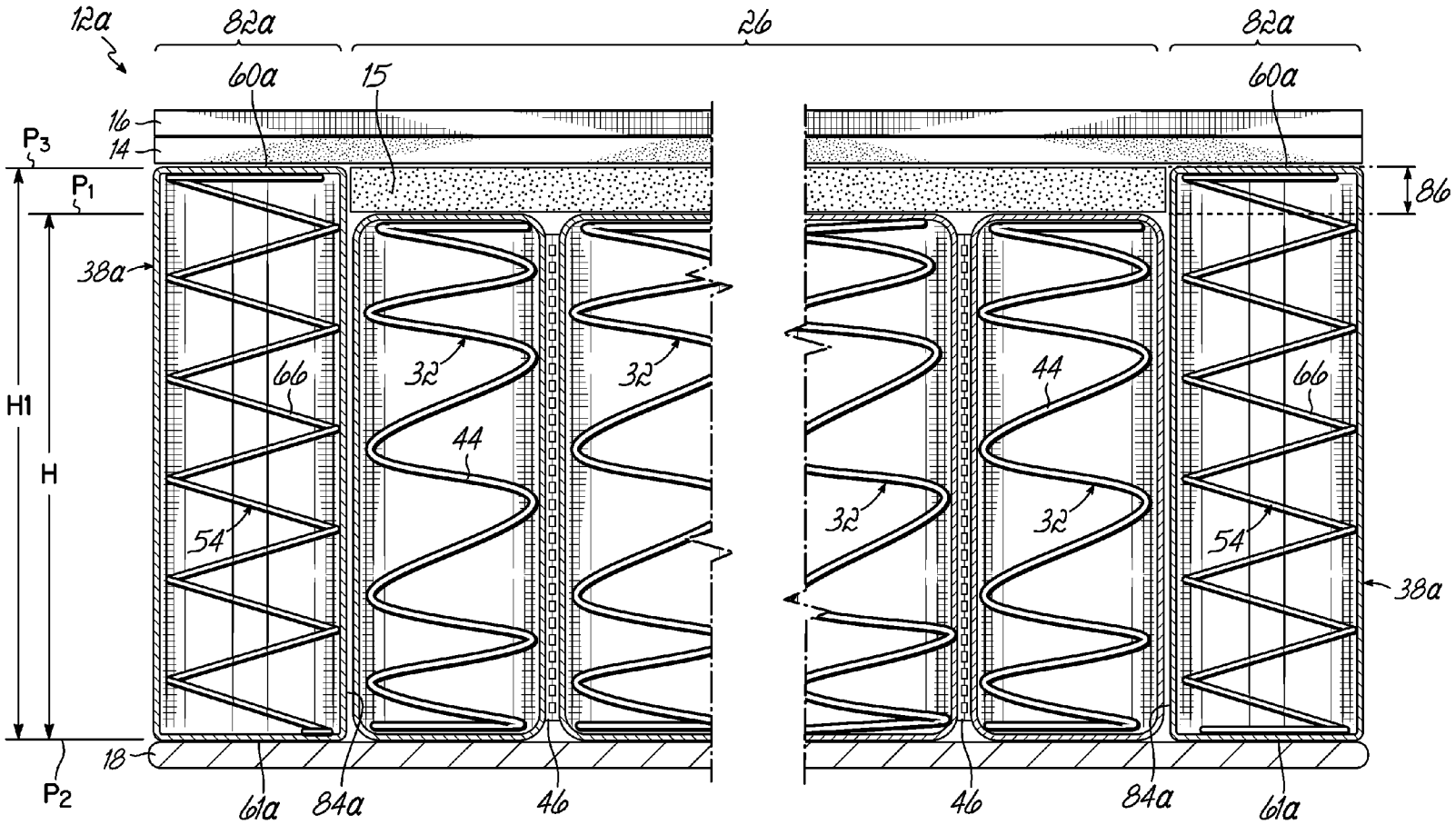
FIG. 6A is a cross-sectional view, partially broken away, taken along the line 6A-6A of FIG. 6 without the covering.

FIGS. 6 and 6A illustrate an alternative embodiment of one-sided bedding or seating product 10*a* having a pocketed spring assembly 12*a*. Pocketed spring assembly 12*a* is slightly different than pocketed spring assembly 12 of product 10. The interior pocketed spring core 28 comprising multiple interior strings of springs 26 of a height H of pocketed spring assembly 12*a* is identical to the interior pocketed spring core 28 of pocketed spring assembly 12 of bedding product 10.

However, the perimeter string of springs 38*a* of pocketed spring assembly 12*a* is taller than perimeter string of springs 38 described above and illustrated in FIGS. 1-5. As best shown in FIG. 6A, the string of pocketed perimeter springs 38*a* has a generally planar top surface 60*a* in top plane P3, and a parallel generally planar bottom surface 61*a* in a bottom plane P2. The linear distance between the top and bottom surfaces 60*a*, 61 *a* of the string of pocketed perimeter springs 38*a* defines a height H1 of the perimeter string of pocketed springs 38*a*. This linear distance is greater than the height H of the interior pocketed spring core 28 of pocketed spring assembly 12*a* of bedding product 10*a*. Therefore, this embodiment of product has additional edge support.

The perimeter string of springs 38*a* of pocketed spring assembly 12*a* has a generally rectangular shape comprising two linear end portions 80*a* (only one being shown) and two linear side portions 82*a*. The end portions 80*a* are glued or otherwise secured to the outermost transversely extending interior strings of springs 26, and the side portions 82*a* are glued or otherwise secured to the outermost pockets 30 of the transversely extending interior strings of springs 26 along seams 84*a*. In the event, the interior strings of springs 26 extend longitudinally, rather than transversely extending, the end portions 80*a* would be glued or otherwise secured to the outermost pockets 30 of the longitudinally extending interior strings of springs 26, and the side portions 82*a* would be glued or otherwise secured to the outermost longitudinally extending interior strings of springs 26.

The difference in height between the height H1 of the perimeter string of pocketed springs 38*a* and the lesser height H of the interior strings of springs 26 creates a trough 86 inside which resides a generally rectangular shaped cushion 15, as shown in FIG. 6A. The cushion 15 may be made of foam, fiber, gel, a pocketed spring topper or any combination thereof or any other suitable material. Although the cushion 15 is shown as a single piece, it may comprise multiple pieces joined together or separated.

Figure 7:
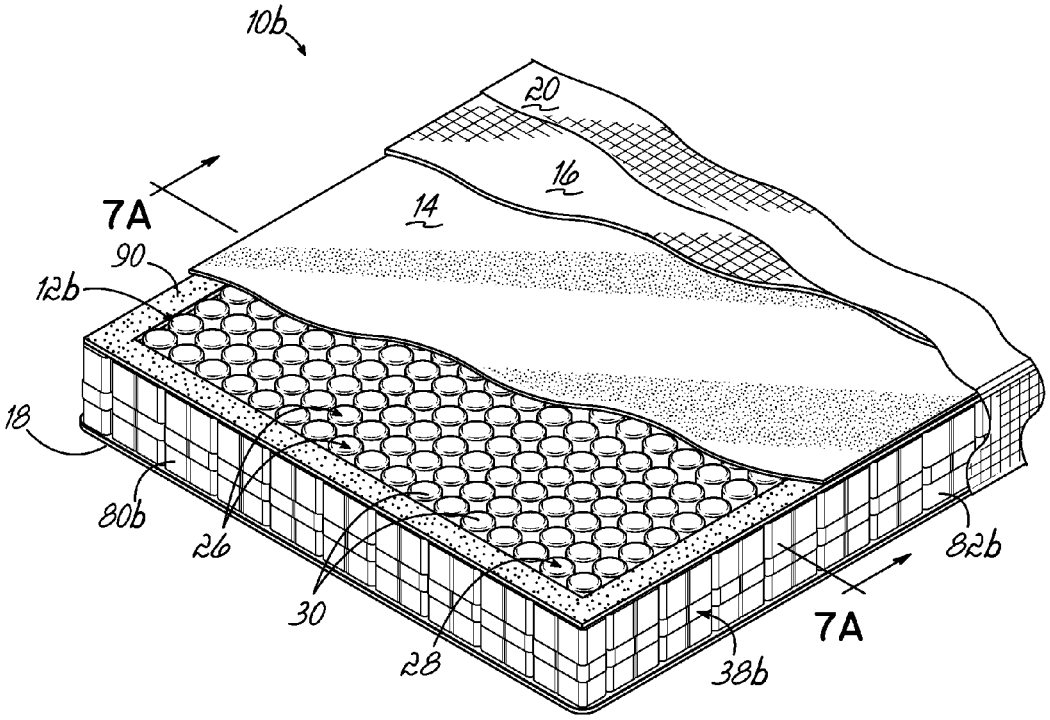
FIG. 7 is a perspective view, partially broken away, of a portion of an alternative pocketed spring assembly.
Figure 7A:
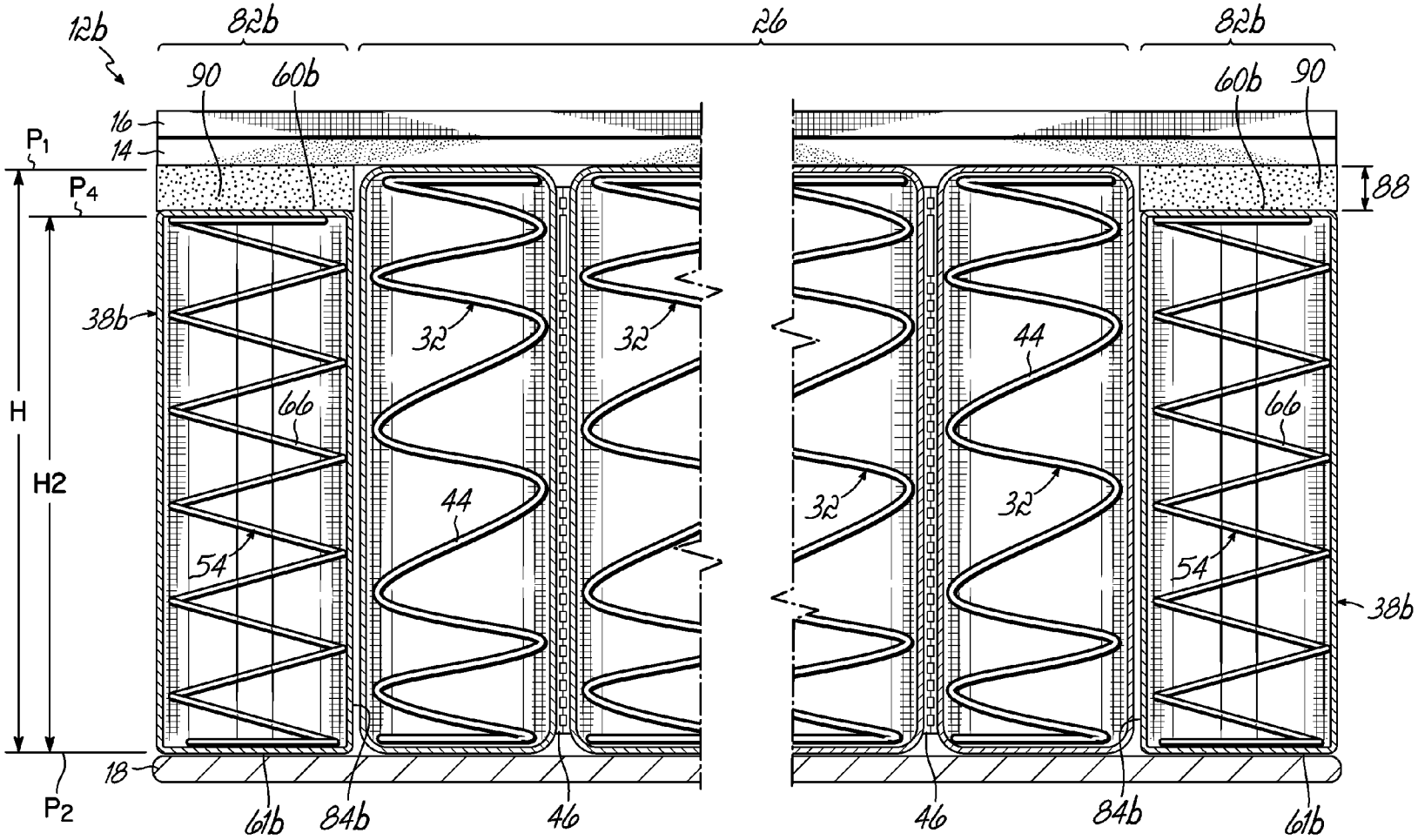
FIG. 7A is a cross-sectional view, partially broken away, taken along the line 7A-7A of FIG. 7 without the covering.

FIGS. 7 and 7A illustrate an alternative embodiment of one-sided bedding or seating product 10*b* having a pocketed spring assembly 12*b*. Pocketed spring assembly 12*b* is slightly different than pocketed spring assembly 12 of product 10. The interior pocketed spring core 28 comprising multiple interior strings of springs 26 of a height H of pocketed spring assembly 12*b* is identical to the interior pocketed spring core 28 of pocketed spring assembly 12 of bedding product 10.

However, the perimeter string of springs 38*b* of pocketed spring assembly 12*b* is shorter than perimeter string of springs 38 described above and illustrated in FIGS. 1-5. As best shown in FIG. 7A, the string of pocketed perimeter springs 38*b* has a generally planar top surface 60*b* in top plane P4 and a parallel generally planar bottom surface 61*b* in a bottom plane P2. The linear distance between the top and bottom surfaces 60*b*, 61 *b* of the string of pocketed perimeter springs 38*b* defines a height H2 of the string of pocketed perimeter springs 38*b*. This linear distance is less than the height H of the interior pocketed spring core 28 of pocketed spring assembly 12*b* of bedding product 10*b*. Therefore, this embodiment of product needs additional edge support.

The perimeter string of springs 38*b* of pocketed spring assembly 12*b* has a generally rectangular shape comprising two linear end portions 80*b* (only one being shown) and two linear side portions 82*b*. The end portions 80*b* are glued or otherwise secured to the outermost transversely extending interior strings of springs 26, and the side portions 82*b* are glued or otherwise secured to the outermost pockets 30 of the transversely extending interior strings of springs 26 along seams 84*b*. In the event the interior strings of springs 26 extend longitudinally, rather than transversely extending, the end portions 80*b* would be glued or otherwise secured to the outermost pockets 30 of the longitudinally extending interior strings of springs 26, and the side portions 82*b* would be glued or otherwise secured to the outermost longitudinally extending interior strings of springs 26.

The difference in height between the height H2 of the perimeter string of pocketed springs 38*b* and the greater height H of the interior strings of springs 26 creates a generally rectangular trough 88 inside which resides a generally rectangular-shaped cushion 90, as shown in FIG. 7A. The cushion 90 may be made of foam, fiber, gel, a pocketed spring topper or any combination thereof, including any other suitable material.

Figure 8:
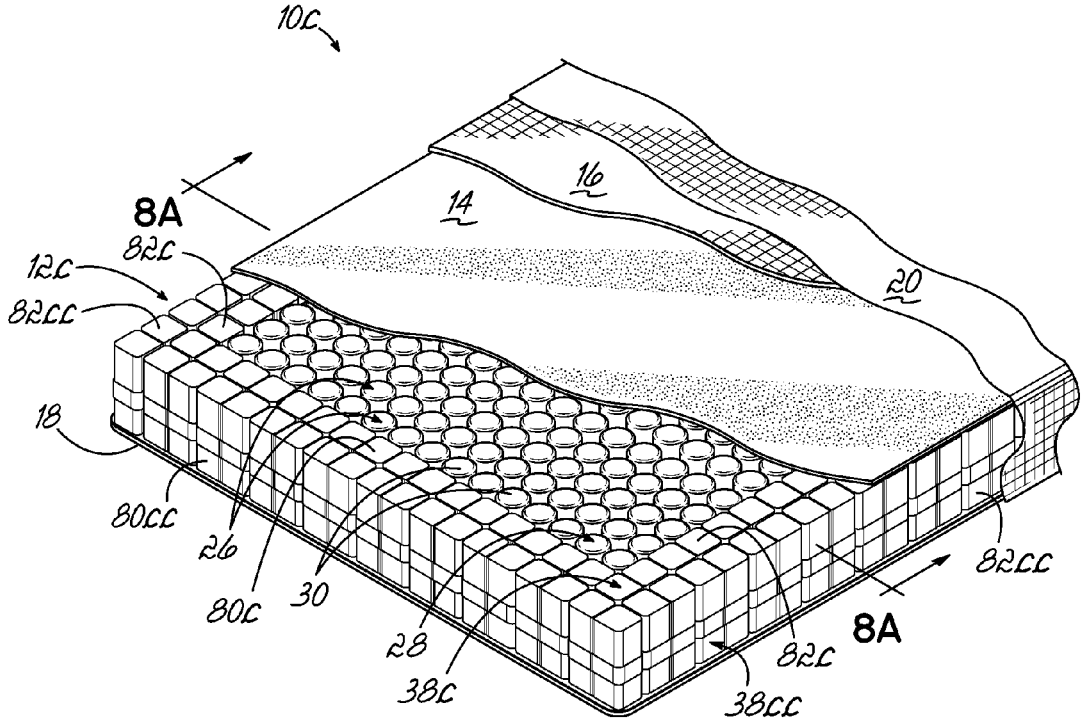
FIG. 8 is a perspective view, partially broken away, of a portion of an alternative pocketed spring assembly.
Figure 8A:
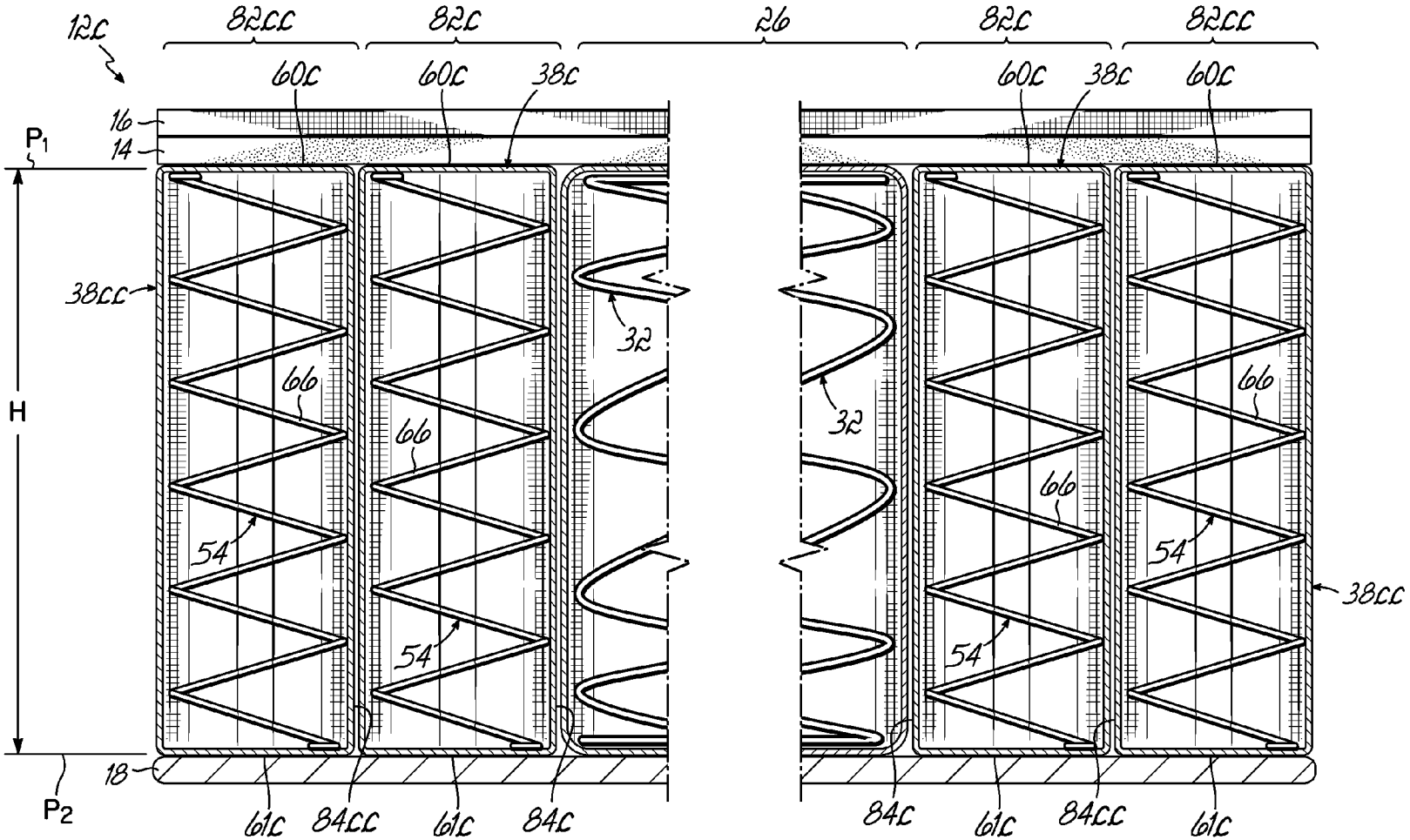
FIG. 8A is a cross-sectional view, partially broken away, taken along the line 8A-8A of FIG. 8 without the covering.

FIGS. 8 and 8A illustrate an alternative embodiment of one-sided bedding or seating product 10*c* having a pocketed spring assembly 12*c*. Pocketed spring assembly 12*c* is slightly different than pocketed spring assembly 12 of product 10. The interior pocketed spring core 28 comprising multiple interior strings of springs 26 of a height H of pocketed spring assembly 12*b* is identical to the interior pocketed spring core 28 of pocketed spring assembly 12 of bedding product 10.

However, the pocketed spring core 12*c* has two perimeter strings of springs 38*c*, 38*cc* of the same height, as opposed to one. Each of the perimeter strings of springs 38*c*, 38*cc* of pocketed spring assembly 12*c* is the same height as perimeter string of springs 38 described above and illustrated in FIGS. 1-5 and the same height as the interior strings of springs 26 of the interior pocketed spring core 28. As best shown in FIG. 8A, each of the perimeter strings of pocketed springs 38*c*, 38*cc* has a generally planar top surface 60*c* in top plane P1 and a parallel generally planar bottom surface 61*c* in a bottom plane P2. The linear distance between the top and bottom surfaces 60*c*, 61 *c* of each perimeter string of pocketed springs 38*c*, 38*cc* defines a height H of the string of pocketed perimeter springs. This linear distance is identical to the height H of the interior pocketed spring core 28 of pocketed spring assembly 12*c* of bedding product 10*c*.

The inner perimeter string of springs 38*c* of pocketed spring assembly 12*c* has a generally rectangular shape comprising two linear end portions 80*c* (only one being shown) and two linear side portions 82*c*. The end portions 80*c* are glued or otherwise secured to the outermost transversely extending interior strings of springs 26, and the side portions 82*c* are glued or otherwise secured to the outermost pockets 30 of the transversely extending interior strings of springs 26 along seams 84*c*. The outer perimeter string of springs 38*cc* of pocketed spring assembly 12*c* has a generally rectangular shape comprising two linear end portions 80*cc* (only one being shown) and two linear side portions 82*cc*. The end portions 80*cc* are glued or otherwise secured to the linear end portions 80*c* of the inner perimeter string of springs 38*c* (only one being shown), and the side portions 82*cc* are glued or otherwise secured to the linear end portions 80*c* of the inner perimeter string of springs 38*c* along seams 84*cc*.

FIGS. 9 and 9A illustrate an alternative embodiment of two-sided bedding or seating product 10*d* having a pocketed spring assembly 12*d*. Pocketed spring assembly 12*d* is slightly different than pocketed spring assembly 12 of product 10. The interior pocketed spring core 28 comprising multiple interior strings of springs 26 of a height H of pocketed spring assembly 12*d* is identical to the interior pocketed spring core 28 of pocketed spring assembly 12 of bedding product 10.

However, the perimeter string of springs 38*d* of pocketed spring assembly 12*d* is taller than perimeter string of springs 38 described above and illustrated in FIGS. 1-5. As best shown in FIG. 6A, the string of pocketed perimeter springs 38*d* has a generally planar top surface 60*d* in top plane P5 and a parallel generally planar bottom surface 61*d* in a bottom plane P6. The linear distance between the top and bottom surfaces 60*d*, 61 *d* of the string of pocketed perimeter springs 38*d* defines a height H3 of the perimeter string of pocketed springs 38*d*. This linear distance is greater than the height H of the interior pocketed spring core 28 of pocketed spring assembly 12*d* of bedding product 10*d*. Therefore, this embodiment of product has additional edge support.

The perimeter string of springs 38*d* of pocketed spring assembly 12*d* has a generally rectangular shape comprising two linear end portions 80*d* (only one being shown) and two linear side portions 82*d*. The end portions 80*d* are glued or otherwise secured to the outermost transversely extending interior strings of springs 26, and the side portions 82*d* are glued or otherwise secured to the outermost pockets 30 of the transversely extending interior strings of springs 26 along seams 84*d*. In the event the interior strings of springs 26 extend longitudinally, rather than transversely extending, the end portions 80*d* would be glued or otherwise secured to the outermost pockets 30 of the longitudinally extending interior strings of springs 26, and the side portions 82*d* would be glued or otherwise secured to the outermost longitudinally extending interior strings of springs 26.

The difference in height between the height H3 of the perimeter string of pocketed springs 38*d* and the lesser height H of the interior strings of springs 26 creates a trough 92 on each side of the mattress 10 inside which resides a generally rectangular-shaped cushion 94, as shown in FIG. 9A. The cushion 94 may be made of foam, fiber, gel, a pocketed spring topper or any combination thereof or any other suitable material. Although the cushion 94 is shown as a single piece, it may comprise multiple pieces joined together or separated.

Figure 10A:
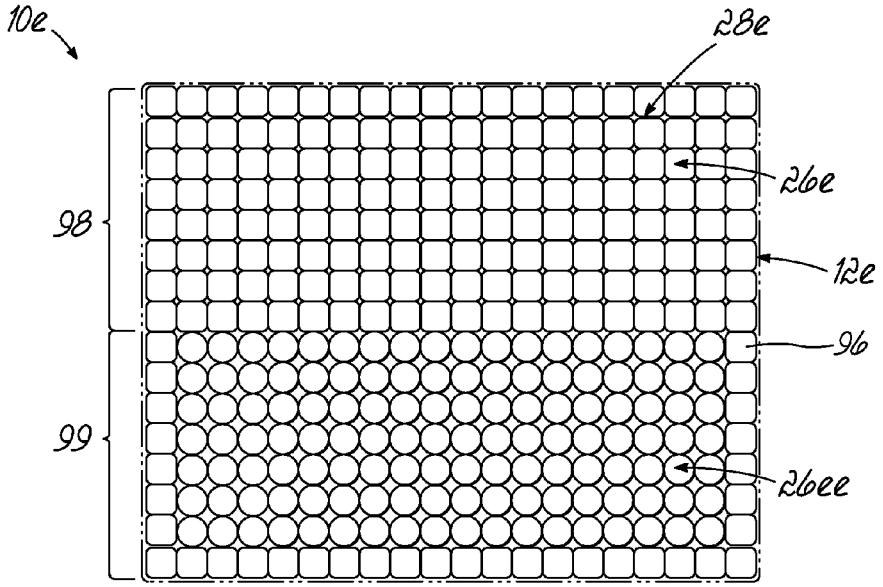
FIG. 10A is a top view of another embodiment of pocketed spring assembly.

FIG. 10A illustrates an alternative embodiment of bedding product 10*e*. This product 10*e* may be a single-sided or double-sided product having a pocketed spring assembly 12*e*. The product 10*e* has a perimeter string of springs 96, which may be identical to any perimeter string of springs shown or described herein. However, the interior pocketed spring core 28*e* of pocketed spring assembly 12*e* is different than any of the interior pocketed spring cores shown or described herein. The interior pocketed spring core 28*e* of pocketed spring assembly 12*e* of this embodiment is posturized or has different regions of different firmness due to the constructions of the strings of springs used in the interior pocketed spring core 28*e* of pocketed spring assembly 12*e*. Although illustrated as having two regions or areas of different firmness F1 and F2, such a posturized pocketed spring assembly may have any number of such regions across the width of the product.

As illustrated in FIG. 10A, the interior pocketed spring core 28*e* of pocketed spring assembly 12*e* has a plurality of longitudinally extending interior strings of springs 26*e*, 26*ee* joined together. The interior pocketed spring core 28*e* of pocketed spring assembly 12*e* of the mattress 10*e* has a "firm" side or region 98 and a "soft" side or region 99. The "firm" portion F1 is firmer than the "soft" portion F2 due to the construction of the interior strings of springs making up each side, portion or region. For example, the "firm" side 98 of interior pocketed spring core 28*e* of pocketed spring assembly 12*e* may comprise interior strings of springs 26*e*, while the "soft" side 99 of pocketed spring assembly 12*e* may comprise interior strings of springs 26*ee*. Because the convolutions of the pocketed springs of interior strings of springs 26*ee* are circular, rather than rectangular like the convolutions of the springs of interior strings of springs 26*ee*, the firmness of the group of connected interior strings of springs 26*e* in section 99 of pocketed spring assembly 12*e* is less firm or "softer" than the firmness of the group of connected interior strings of springs 26*ee* in section 98 of pocketed spring assembly 12*e*.

Figure 10B:
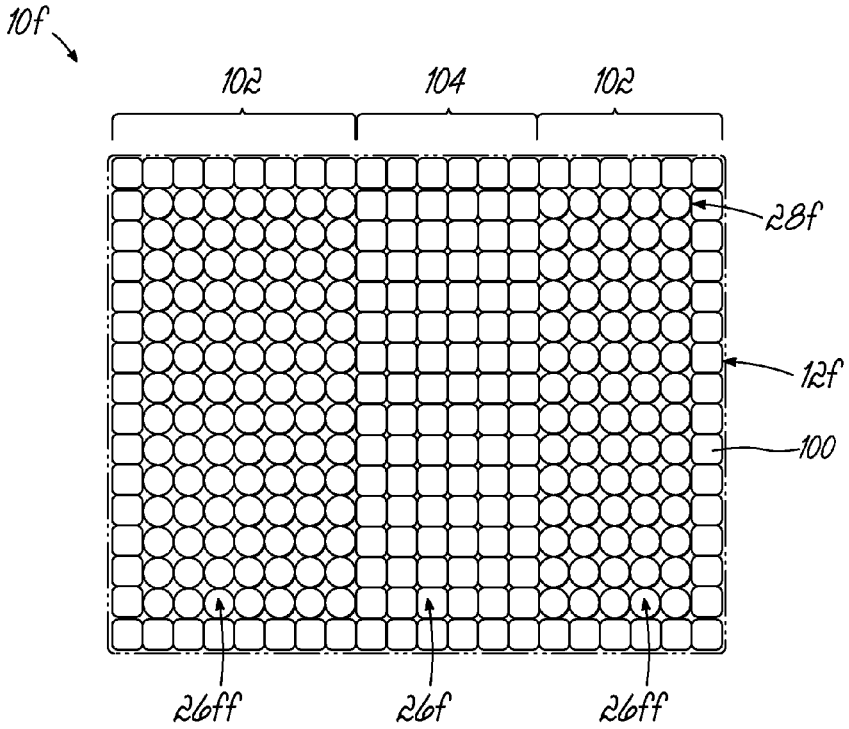
FIG. 10B is a top view of another embodiment of pocketed spring assembly.

FIG. 10B illustrates another alternative embodiment of bedding product 10*f*. This product 10*f* may be a single-sided or double-sided product having a pocketed spring assembly 12*f*. The product 10*f* has a perimeter string of springs 100 which may be identical to any perimeter string of springs shown or described herein. However, the interior pocketed spring core 28*f* of pocketed spring assembly 12*f* is different than any of the interior pocketed spring cores shown or described herein. The pocketed spring assembly 12*f* of this embodiment is posturized or has different regions of different firmness due to the constructions of the interior strings of springs 26*f*, 26*ff* used in the interior pocketed spring core 28*e* of pocketed spring assembly 12*e*. Although illustrated as having three regions or areas of two different firmnesses 102, 104, such a posturized pocketed spring assembly may have any number of such regions across the length of the product.

As illustrated in FIG. 10B, the interior pocketed spring assembly 28*f* has a plurality of transversely extending strings of springs 26*f*, 26*ff* joined together. The interior pocketed spring assembly 28*f* of the mattress 10*f* has a "firm" area or region 104 and two "soft" areas or regions 102 on opposite sides of the firm region 104, the "firm" portion 104 being firmer than the "soft" portions 102, due to the construction of the interior strings of springs making up each portion or region. For example, the "firm" region 104 of interior pocketed spring assembly 28*f* may comprise strings of springs 26*f* containing springs having rectangular convolutions, as shown in FIG. 3, while the "soft" regions 102 of interior pocketed spring assembly 28*f* may comprise strings of springs 26*ff* having conventional coil springs. Because the convolutions of the pocketed springs of interior strings of springs 26*ff* are circular, rather than rectangular like the convolutions of the springs of interior strings of springs 26*f*, the firmness of the group of connected interior strings of springs 26*f* in sections 102 of pocketed spring assembly 12*f* is less firm or "softer" than the firmness of the group of connected interior strings of springs 26*ff* in section 104 of pocketed spring assembly 12*f*.

Figure 11A:
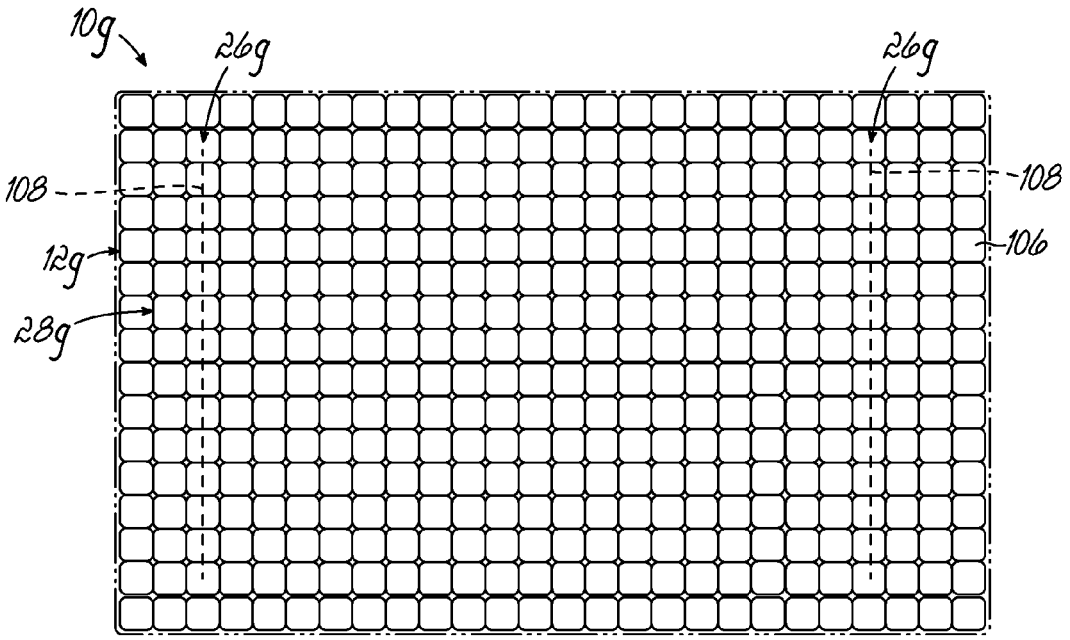
FIG. 11A is a top view of another embodiment of pocketed spring assembly.

FIG. 11A illustrates an alternative embodiment of bedding product 10*g*. This product 10*g* comprises a pocketed spring assembly 12*g*, which may have a uniform, non-posturized "feel" or firmness. The pocketed spring assembly 12*g* comprises an interior pocketed spring assembly 28*g* and a perimeter string of springs 106 glued or otherwise secured together around the perimeter of the interior pocketed spring assembly 28*g*. The interior pocketed spring assembly 28*g* comprises a plurality of joined transversely extending strings of springs 26*g* extending in the direction shown by the dashed line 108. Each of the transversely extending strings of springs 26*g* of the interior pocketed spring assembly 28*g* has springs with rectangular convolutions, like the string of springs shown in FIG. 4. The height of the perimeter string of springs 106 may be identical to, less than or greater than the height of all or some of the transversely extending strings of springs 26*g* of the interior pocketed spring assembly 28*g*. The height of the transversely extending strings of springs 26*g* of the interior pocketed spring assembly 28*g* is commonly uniform; however, some of the transversely extending strings of springs 26*g* of the interior pocketed spring assembly 28*g* may be a different height than others.

Figure 11B:
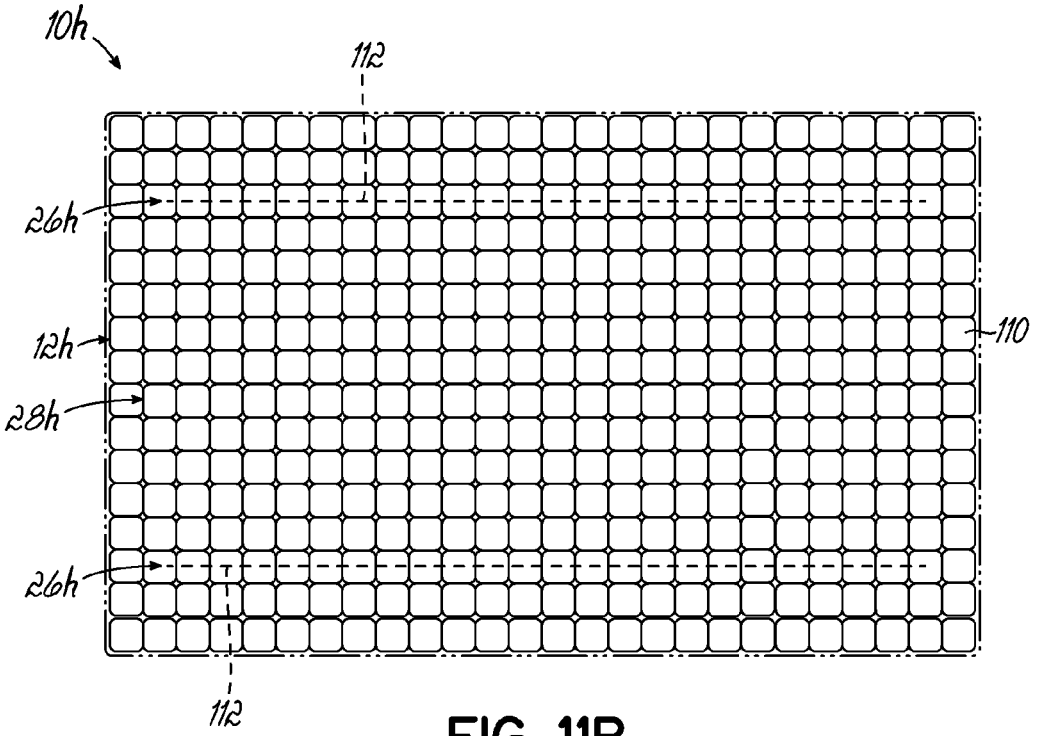
FIG. 11B is a top view of another embodiment of pocketed spring assembly.

FIG. 11B illustrates an alternative embodiment of bedding product 10*h*. This product 10*h* comprises a pocketed spring assembly 12*h*, which may have a uniform, non-posturized "feel" or firmness. The pocketed spring assembly 12*h* comprises an interior pocketed spring assembly 28*h* and a perimeter string of springs 110 glued or otherwise secured together around the perimeter of the interior pocketed spring assembly 28*h*. The interior pocketed spring assembly 28*h* comprises a plurality of joined longitudinally extending strings of springs 26*h* extending in the direction shown by the dashed line 112. Each of the longitudinally extending strings of springs 26*h* of the interior pocketed spring assembly 28*h* has springs with rectangular convolutions, like the string of springs shown in FIG. 4. The height of the perimeter string of springs 110 may be identical to, less than or greater than the height of all or some of the longitudinally extending strings of springs 26*h* of the interior pocketed spring assembly 28*h*. The height of the longitudinally extending strings of springs 26*h* of the interior pocketed spring assembly 28*h* is commonly uniform; however, some of the longitudinally extending strings of springs 26*h* of the interior pocketed spring assembly 28*h* may be a different height than others.

While I have described several preferred embodiments of this invention, persons skilled in this art will appreciate that other strings of springs may be utilized in the practice of this invention. Similarly, such persons will appreciate that each pocket may contain any number of coil springs or other type of spring, made of any desired material. Therefore, I do not intend to be limited except by the scope of the following appended claims.

I claim:

1. A bedding or seating product comprising: a pocketed spring assembly comprising an interior pocketed spring core comprising a plurality of interior strings of springs joined to each other, each of the interior strings of springs comprising a plurality of interconnected pockets, each of the pockets containing at least one coil spring encased in fabric, the fabric being joined to itself along a longitudinal seam and adjacent individually pocketed coil springs being separated from each other by at least one separating seam joining opposed first and second plies; the pocketed spring assembly further comprising at least one perimeter string of springs, each perimeter string of springs being one continuous string of pocketed springs surrounding four sides of the interior pocketed spring core and comprising a plurality of interconnected perimeter pockets, at least some of the plurality of perimeter pockets being connected to adjacent perimeter pockets at diagonal adjacent corners, each of the perimeter pockets containing at least one perimeter spring having rectangular convolutions, each perimeter spring being encased in fabric, each perimeter pocket comprising four substantially planar side surfaces, wherein one of the substantially planar side surfaces is substantially parallel to and directly contacts one of the substantially planar side surfaces of one of the adjacent perimeter pockets;

cushioning materials on at least one side of the pocketed spring assembly; and a covering encasing the pocketed spring assembly and cushioning materials.

2. A pocketed spring assembly for use in a bedding or seating product, the pocketed spring assembly comprising: an interior pocketed spring core comprising a plurality of interior strings of springs joined to each other, each of the interior strings of springs comprising a plurality of interconnected pockets, each of the pockets containing at least one coil spring encased in fabric, the fabric being joined to itself along a longitudinal seam and adjacent individually pocketed coil springs being separated from each other by at least one separating seam joining opposed first and second plies; and the pocketed spring assembly further comprising at least one perimeter string of springs, each perimeter string of springs being one continuous string of pocketed springs surrounding four sides of the interior pocketed spring core and comprising a plurality of interconnected perimeter pockets, at least some of the plurality of perimeter pockets being connected to adjacent perimeter pockets at diagonal adjacent corners, each of the perimeter pockets containing at least one perimeter spring having rectangular convolutions, each perimeter spring being encased in fabric, each perimeter pocket comprising four substantially planar side surfaces, wherein one of the substantially planar side surfaces is substantially parallel to and directly contacts one of the substantially planar side surfaces of one of the adjacent perimeter pockets.

3. The pocketed spring assembly of claim 2 wherein each of the perimeter springs has square upper and lower end turns and a plurality of square central convolutions between the end turns.

4. The pocketed spring assembly of claim 2 wherein the perimeter springs have the same height as the coil springs.

5. The pocketed spring assembly of claim 3 wherein the perimeter springs have a different height than the height of the coil springs.

6. The pocketed spring assembly of claim 2 wherein the perimeter springs have a greater height than the height of the coil springs.

7. The pocketed spring assembly of claim 2 wherein the coil springs have a greater height than the height of the perimeter springs.

8. The pocketed spring assembly of claim 2 wherein the interior strings of springs extend transversely.

9. The pocketed spring assembly of claim 2 wherein the interior strings of springs extend longitudinally.

10. The pocketed spring assembly of claim 2 wherein the longitudinal seam is on one side of the interior string of springs.

11. A pocketed spring assembly for use in a bedding or seating product, the pocketed spring assembly comprising: an interior pocketed spring core comprising a plurality of interior strings of springs joined to each other, each of the interior strings of springs comprising a plurality of interconnected pockets, each of the pockets containing at least one coil spring encased in fabric; and the pocketed spring assembly further comprising at least one perimeter string of springs, each perimeter string of springs being one continuous string of pocketed springs surrounding four sides of the interior pocketed spring core and comprising a plurality of interconnected perimeter pockets, at least some of the plurality of perimeter pockets being connected to adjacent perimeter pockets at diagonal adjacent corners, each of the perimeter pockets of the perimeter string of springs containing at least one perimeter spring having rectangular convolutions, each perimeter spring being encased in fabric, each perimeter pocket comprising four substantially planar side surfaces, wherein one of the substantially planar side surfaces is substantially parallel to and directly contacts one of the substantially planar side surfaces of one of the adjacent perimeter pockets.

12. The pocketed spring assembly of claim 11 wherein each of the perimeter springs has square upper and lower end turns and a plurality of square central convolutions between the end turns.

13. The pocketed spring assembly of claim 11 wherein the perimeter springs have the same height as the coil springs.

14. The pocketed spring assembly of claim 11 wherein the perimeter springs have a different height than the height of the coil springs.

15. The pocketed spring assembly of claim 14 wherein the perimeter springs have a greater height than the height of the coil springs.

16. The pocketed spring assembly of claim 14 wherein the coil springs have a greater height than the height of the perimeter springs.

17. The pocketed spring assembly of claim 11 wherein each of the coil springs are the same height.

18. A pocketed spring assembly for use in a bedding or seating product, the pocketed spring assembly comprising: an interior pocketed spring core comprising a plurality of interior strings of springs joined to each other, each of the interior strings of springs comprising a plurality of interconnected pockets, each of the pockets containing at least one interior spring encased in fabric, the fabric being joined to itself along a longitudinal seam and adjacent individually pocketed interior springs being separated from each other by at least one separating seam joining opposed first and second plies; and the pocketed spring assembly further comprising at least one perimeter string of springs, each perimeter string of springs being one continuous string of pocketed springs surrounding four sides of the interior pocketed spring core and comprising a plurality of interconnected perimeter pockets, at least some of the plurality of perimeter pockets being connected to adjacent perimeter pockets at diagonal adjacent corners, each of the perimeter pockets containing at least one perimeter spring encased in fabric, each perimeter spring having square convolutions and each perimeter pocket comprising four substantially planar side surfaces wherein one of the substantially planar side surfaces is substantially parallel to and directly contacts one of the substantially planar side surfaces of one of the perimeter pockets.

19. The pocketed spring assembly of claim 18 wherein the fabric of each perimeter string of springs is joined to itself along a longitudinal seam and adjacent individually pocketed perimeter springs being separated from each other by at least one separating seam joining opposed first and second plies.

20. The pocketed spring assembly of claim 18 wherein the longitudinal seam of each perimeter strings of springs is on one side of the perimeter string of springs.

21. The pocketed spring assembly of claim 18 wherein the perimeter springs have the same height as the interior springs.

22. The pocketed spring assembly of claim 18 wherein the interior springs are coil springs.

23. The pocketed spring assembly of claim 18 wherein the perimeter springs have a greater height than the height of the interior springs.

24. The pocketed spring assembly of claim 18 wherein the interior springs have a greater height than the height of the perimeter springs.

25. The pocketed spring assembly of claim 18 wherein each of the interior springs are the same height.

26. A pocketed spring assembly comprising: an interior pocketed spring core comprising a plurality of interior strings of springs joined to each other, each of the interior strings of springs comprising a plurality of interconnected pockets, each of the pockets containing at least one coil spring encased in fabric, the fabric being joined to itself along a longitudinal seam and adjacent individually pocketed springs being separated from each other by at least one separating seam; and the pocketed spring assembly further comprising at least one perimeter string of springs, each perimeter string of springs being one continuous string of pocketed springs surrounding at least one corner of the interior pocketed spring core and comprising a plurality of interconnected perimeter pockets, each of the perimeter pockets containing at least one perimeter spring having rectangular convolutions, each perimeter spring being encased in fabric, each perimeter pocket comprising four substantially planar side surfaces, wherein one of the substantially planar side surfaces is substantially parallel to and directly contacts one of the substantially planar side surfaces of one of the adjacent perimeter pockets.

27. The pocketed spring assembly of claim 26 wherein the perimeter springs have the same height as the coil springs.

28. The pocketed spring assembly of claim 26 wherein the perimeter springs have a different height than the height of the coil springs.

29. The pocketed spring assembly of claim 26 wherein the perimeter springs have a greater height than the height of the coil springs.

* * * * *